United States Patent [19]

Bradlee

[11] 4,347,723

[45] Sep. 7, 1982

[54] METHOD AND APPARATUS FOR TENSIONING METALLIC STRIPS ON A SLITTING LINE

[75] Inventor: Charles R. Bradlee, Sidney, Ohio

[73] Assignee: The Monarch Machine Tool Company, Sidney, Ohio

[21] Appl. No.: 180,534

[22] Filed: Aug. 22, 1980

[51] Int. Cl.[3] ..... B21C 47/04; B21C 47/26; B65H 35/02

[52] U.S. Cl. ..... 72/130; 72/147; 72/203; 242/56.2

[58] Field of Search ..... 72/129, 130, 132, 147, 72/148, 179, 180, 203, 205; 242/56.1, 56.2, 56.3, 56.7, 56.8

[56] References Cited

U.S. PATENT DOCUMENTS

| | | | |
|---|---|---|---|
| 2,726,051 | 12/1955 | Deichert | 242/78 |
| 2,969,585 | 1/1961 | Smith | 29/605 |
| 3,685,711 | 8/1972 | Gay | 226/191 |
| 3,771,738 | 11/1973 | Abbey | 242/75.2 |
| 3,991,952 | 11/1976 | Altman et al. | 242/56.9 |
| 4,093,140 | 6/1978 | Matsunaga | 242/56.2 |
| 4,173,313 | 11/1979 | Rogers | 242/56.2 |
| 4,201,352 | 5/1980 | Madachy | 242/56.2 |
| 4,215,806 | 8/1980 | Holmstrom | 226/195 |
| 4,234,300 | 11/1980 | Yamagisi et al. | 425/363 |

FOREIGN PATENT DOCUMENTS 50-35906 11/1975 Japan ..... 72/203

*Primary Examiner*—Ervin M. Combs
*Attorney, Agent, or Firm*—Biebel, French & Nauman

[57] ABSTRACT

A method of tensioning metallic strips on a slitting line is combined with the steps of uncoiling a metallic web having a non-uniform cross sectional thickness from an uncoiler, slitting the web into a plurality of strips having varying thicknesses, and recoiling the strips into individual strip coils on a recoiler, the tensioning method being the additional step of deforming the thinner portions of the web intermediate the uncoiling and recoiling steps so that a raised pattern is imparted to the thinner portions thereby increasing the effective cross sectional thicknesses of the thinner strips to that of the thicker strips so that the strip coils formed from the strips are of similar diameter and the strips can be recoiled at the same rate, thus preventing the formation of slack strips. The apparatus includes a deforming station having a forming roll with a raised pattern formed on its surface, a pressure roll having a width less than that of the forming roll, and a frame for supporting the forming roll above the pressure roll. The frame includes a movable support for the pressure roll which positions the pressure roll and urges it toward or away from the forming roll.

20 Claims, 16 Drawing Figures

METHOD AND APPARATUS FOR TENSIONING METALLIC STRIPS ON A SLITTING LINE

BACKGROUND OF THE INVENTION

1. Field of the Invention

The present invention relates to methods and apparatus for recoiling metallic strips on a slitting line, and more particularly, to those methods and devices implementing steps or components for maintaining uniform tension in the strips as they are being recoiled.

2. Prior Art

Sheet metal produced by strip mills is typically sold in large, coiled rolls since the cost of producing sheet metal on a per pound basis varies inversely with the width of the sheet produced. Those purchasing these large coils and desiring to manufacture various products from the sheet metal find it necessary to have the sheet metal slit into narrow strips on a slitting line. The basic components of a slitting line are an uncoiler, on which is mounted the coiled sheet metal, a slitting machine having upper and lower rolls fitted with a plurality of knife edges which interact to slit the web from the coiled sheet metal into a plurality of strips, and a recoiler having a mandrel on which the slitted strips are recoiled into individual strip coils. In addition, a typical slitting line may contain a number of other components such as edge control devices to maintain the horizontal orientation of the web as it is being fed into the slitter, pinch rolls which facilitate the entry of the web into the slitting machine, and drag wipes for maintaining proper tensioning of the strips as they are taken up on the recoiler.

A problem inherent in the operation of all slitting lines is caused by the variation in thickness across the width of the sheet. Present sheet metal forming processes produce sheet metal that is thinner at its longitudinal edges than at its center, resulting in a "crowned" contour or slight convexity across its width. As sheet metal having such a crowned contour is slit and recoiled into separate strip coils on the recoiler, the strips formed from the portion of the web adjacent its longitudinal edges are thinner than those formed from the center of the web.

As the strips are rewound into coils, those strip coils formed from the thinner outer strips do not increase in diameter at the same rate as those strip coils formed from the thicker center strips. For a given number of mandrel revolutions, the diameter of a strip coil—made up of successive windings of thin strips—will be less than one made up of successive windings of thick strips. The result is that, for each revolution of the mandrel on the recoiler, a shorter length of a thin strip is being wound onto its respective strip coil than the length of thick center strip wound onto the center coils. Since the metal web is fed into and emerges from the slitter at the same rate across its width, this difference in recoiling rate results in a slackening of the thin strips from the slitter to the recoiler while the thicker strips remain properly tensioned. If a large coil of sheet metal is being slit on a slitting line, a considerable amount of slack strip is generated and results in unacceptably loose coils and possible fouling of the slitting line with damage to the material and danger to the personnel in the immediate area of the recoiler.

Many devices have been used in combination with a slitting line in order to compensate for the formation of slack strips between the slitter and the recoiler. For example, U.S. Pat. Nos. 3,771,738 and 3,685,711 disclose a tensioner having a pair of rollers used for maintaining tension between the tensioner and the recoiler, thereby insuring proper tensioning of the strips on the strip coils. However, this results in a slack strip condition between the device and the slitter. As a result, it is necessary to include a looping pit in combination with these tensioning devices so that the slack strips may drop down into the pit during the coiling operation. While the use of a looping pit and tensioning rolls is a simple and effecting expedient, the cost of excavating a looping pit is considerable and makes the relocation of the slitting line extremely impractical.

A second solution to the problem is disclosed in U.S. Pat. Nos. 4,093,140 and 2,726,051. These patents disclose slitting lines in which the strip coils are wound on individual drums mounted on the mandrel of a recoiler. The mandrel turns at a speed that exceends that of any of the individual drums which slip relative to the mandrel. This permits a variation in the rotational speeds of the drums and eliminates slack strips. An inherent disadvantage of such systems is the complexity and expense of the specially designed recoiler and drums. In addition, if strips of varying sizes are to be cut by the slitter, it is necessary to change the width of the drums on the recoiler mandrel making it necessary to maintain a stock of drums of varying widths.

Another solution consists of inserting slips of paper into the nip of a strip coil formed from the thinner strips. The addition of paper between successive windings of the selected strip coil increases the diameter of the strip coil for a given number of windings since the thickness of the paper is added to that of the strips. This process is continued until the diameter of the strip coil approximates that of a strip coil formed from the thicker center strips.

There are many disadvantages inherent in this method. Paper is difficult to insert in the proper location while the line is running. Stopping the operation to insert paper reduces production efficiency. In addition, any moisture contained in or subsequently absorbed by the paper would cause the strip it contacted to rust if the material slit was susceptible to rusting. There is also a danger of the paper combining with oil to stain the metal, which is undesirable when the metal is to be left unpainted and visible when incorporated with the finished product. In applications in which the paper strips are inserted by hand, there exists the danger that the person injecting the paper may become mangled by the recoiler.

Accordingly, it is desirable to operate a slitting line in a manner that eliminates the generation of slack strips between the slitter and the recoiler and does not require expensive looping pits, recoilers with separate drums, or the use of paper strips which increase cost and mar the product.

SUMMARY OF THE INVENTION

The present invention provides an improved method and apparatus for tensioning metallic strips on a slitting line in which the effective thickness of the thin outer strips is increased to that of the thick inner strips so that the strip coils formed from the strips are of similar diameter and recoil the strips at the same rate, thereby preventing the formation of slack strips between the slitter and the recoiler. The effective thickness of the thinner strips is increased by deforming thinner portions of the web prior to slitting so that a raised pattern is imparted to the thinner portions and the strips formed from these thinner portions have an increased effective cross sectional thickness which results in a strip coil having a greater diameter than one made up of thin strips which are not deformed. Since the strip coils have the same effective diameter during the recoiling operation, the length of metal strip recoiled into each strip coil for every revolution of the recoiler mandrel is the same. Therefore, the rate of take up of the slit strips is uniform across the width of the web and the formation of slack strips is eliminated.

The method of the invention involves passing the web, intermediate the uncoiling and recoiling thereof, between two rollers, one of which has a raised pattern formed on its surface. The two rollers are clamped together, thereby forcing the desired portion of the web against the raised pattern and imparting the pattern to the web and the subsequent strip. The pattern formed on the roller can be in the form of raised helical ridges, a plurality of distinct protrusions, or a series of irregular, circumferential ridges.

The apparatus of the invention consists of a deforming station preferably located between the uncoiler and recoiler. The deforming station comprises a frame on which is mounted a forming roll made of metal and bearing a raised pattern. Beneath the forming roll is mounted a pressure roll which is shorter in length and is preferably made of hard rubber which is carried by a support which slidably engages a cross beam which spans the frame.

The support consists of a sliding block with a groove shaped to engage the cross beam of the frame. The sliding block includes two upright members which extend upwardly toward the forming roll and a pair of rocker arms, each pivotally mounted at an end to an upright member. A double-acting cylinder is pivotally mounted to the sliding block at an end and the cylinder rod is attached at an end to the other end of the rocker arms. In this fashion, as the rod extends and retracts from the cylinder the rocker arms rotate relative to the upright members and move towards and away from the forming roll. The pressure roll extends between the rocker arms and is rotatably journalled therein. The support also includes a threaded nut in a lower portion which engages a threaded spindle rotatably mounted transversely across the frame.

A reversible motor is mounted on the frame and linked to the spindle by a drive train, preferably comprising a combination of driven and driving sprocket wheels and a sprocket chain. Thus, rotation of the threaded spindle by the reversible motor causes the nut to move along the threads of the spindle, thereby moving the support in relation to the frame and forming roll.

The apparatus of the invention preferably includes a control located remotely at an operator station which can activate the double-acting cylinder and energize the motor. Thus, all operations required to perform the method of the invention can be performed by a single individual away from the operation of the slitting line.

To perform the method of the invention, the web is first uncoiled from the uncoiler and fed between the forming roll and the pressure roll and then is fed through the slitter at the slitting station. After the slitting operation has begun, the strips are attached to the mandrel of the recoiler and rewound into individual strip coils. As the slitting operation increases in rate up to the full operating speed, the strip coils begin increasing in diameter. However, the strip coils made of strips from the center of the web increase in diameter at a faster rate than those strip coils made up of strips from the edges of the web since the strips in the center of the web are thicker than those at the edges. The resulting differences in strip coil diameters causes a difference in rate of take up of slit strips. Since the web is slit at the same rate and the strips emerge from the slitter at the same rate, a difference in take up speed results in slackened strips between the slitter and the recoiler.

An operator positioned at the operator station, which includes the control, identifies the problem and the targeted slack strips and activates the reversible motor to turn the threaded spindle, thereby positioning the pressure roll below the portion of the web corresponding to the targeted slack strip. After he has positioned the pressure roll below the selected portion of the web, he operates the control to energize the double-acting cylinder so that the rod extends outwardly, thereby pivoting the rocker arms toward the forming roll and clamping the selected portion of the web between the forming roll and the pressure roll. The web is pressed into the pattern of the forming roll and is subsequently deformed, having a pattern matching that of the forming roll.

As strips made from the web and bearing the pattern of the forming roll are recoiled onto the strip coils, their resulting coil is thicker, winding for winding, than a strip coil made up of strips of similar thickness, the additional thickness resulting from the raised pattern carried by the strips. Since the deformed strips have a greater effective thickness than the thick strips slit from the center of the web, the strip coil comprising the deformed strips increases in diameter at a faster rate than the other strip coil. The targeted strip coil is soon of a comparable or greater diameter than the strip coil made from inner strips and the rate at which the outer strips are being rewound will be at least the same as the rate at which the inner strips are being rewound, thereby, eliminating slack.

After eliminating slack at the targeted strip, the operator activates the control to cause the rod to retract into the double-acting cylinder, which disengages the pressure roll from the forming roll. The roll and support can now be repositioned to another location to increase the diameter of another targeted strip coil by activating the reversible motor.

In an alternate embodiment of the invention, the cross beam is positioned above the forming roll so that the sliding block travels above the moving web which is then supported by the forming roll. During the deforming process, an operator positioned at the operator station positions the sliding block above the desired portion of the web to be deformed and activates the double-acting cylinder. The cylinder urges the pressure roll downwardly toward the forming roll, thereby compressing the selected portion of the web and deforming it into the raised pattern on the surface of the forming roll. By positioning the cross beam and sliding block above the web and forming roll, an operator may more easily see the position of the sliding block and thus eliminate the need for electromechanical sensing devices to inform the operator of the position of the sliding block.

It should be noted that it is not necessary that the forming roll carry the raised pattern and the pressure roll have a smooth surface. In an alternate embodiment, the pressure roll has a raised pattern formed on its surface and the forming roll would have a smooth outer surface. As with previously discussed embodiments, during operation of the deforming station, only a preselected portion of the web would be deformed by the pressure roll. In this embodiment, the pressure roll would be formed of a relatively rigid material and the forming roll would be formed from a hardened but flexible material.

It is undesirable to impart a pattern to the targeted strips that will nest upon recoiling into a strip coil, since nesting will not result in an increased effective diameter being imparted to the deformed strips. To remedy the likelihood of nesting occurring during a deforming process, a preferred embodiment includes means to activate the double-acting cylinder selectively and periodically so that the pressure roll is intermittently urged against the forming roll. If this intermittent activation of the pressure roll is timed properly, the resulting strip coil will be comprised of alternating windings of deformed and undeformed strips, thus eliminating the possibility that a given winding of strip will nest into the next lower winding of deformed strip.

The required apparatus may include a cam driven by the recoiler and connected by gearing such as pulleys so that the cam revolves once for every two revolutions of the recoiler. A cam follower driven by the cam will activate a second solenoid which controls the flow of fluid from a hydraulic pump to the first solenoid which activates the double-acting cylinder. This second solenoid has two positions: a first postion in which fluid is diverted to cause the rod to extend from the cylinder thereby causing the pressure roll to force the web into the forming roll, and a second position in which fluid is diverted to cause the rod to retract into the cylinder causing the pressure roll to disengage the web. The cam is shaped so that the solenoid is in each position for one-half revolution of the cam. Thus, as the main solenoid is activated, the cylinder rod extends and retracts alternately so that alternate windings of the selected strip coil are deformed and the likelihood of nesting is eliminated since a winding of undeformed strip is interposed between layers of deformed strip.

Accordingly, it is an object of this invention to provide a method and apparatus of tensioning metallic strips on a slitting line which eliminates the need for expensive looping pits; to provide a safe means of tensioning metallic strips which eliminates the need for personnel to work close to the slitting line; and to provide a method and apparatus for tensioning metallic strips which can be activated and controlled by the same single operator that activates and controls the entire slitting line so that additional personnel are not required.

Other objects and advantages of the invention will be apparent from the following description, the accompanying drawings and the appended claims.

DETAILED DESCRIPTION OF THE PREFERRED EMBODIMENTS

Figure 1:
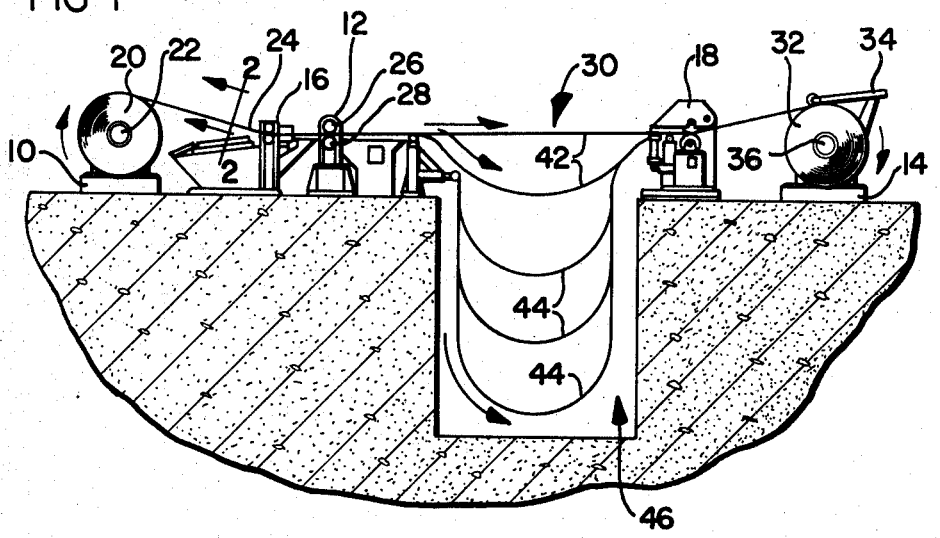
FIG-1 PRIOR ART
FIG. 1 is a somewhat schematic side elevation of a prior art slitting line.

For purposes of background, FIG. 1 of the drawings discloses, somewhat schematically, a conventional slitting line well-known in the prior art which includes an uncoiler 10, slitter 12, and recoiler 14. The conventional slitting line may also include such components as pinch rolls 16 which facilitate the entry of the sheet material into the slitter 12, and tensioner 18 which maintains the tension of the material coiled on the recoiler. Typically a coil of sheet metal 20 is placed upon an unwind mandrel 22 of the uncoiler 10 and a web 24 of sheet metal is uncoiled from the coil and trained through slitter 12. At the slitter 12, upper and lower cutters 26, 28 interact to slit the incoming web into a plurality of strips 30.

The strips 30 are fed through the tensioner 18 and are recoiled into separate strip coils 32, guided by overarm separator 34, and mounted on rewind mandrel 36 of recoiler 14.

Figure 2:
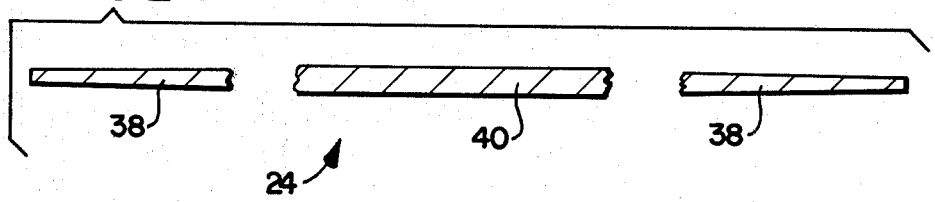
FIG. 2 shows fragments of the strip cross section taken at line 2—2 in FIG. 1 and FIG. 3.

As shown in FIG. 2 the cross sectional thickness of web 24 varies across its width. As a result of the rolling process which occurs during the fabrication of the coil of sheet metal, the side portions 38 are thinner than the center portion 40. A web 24 having such a cross sectional profile is said to have a "crowned" contour.

Referring to FIG. 1, as the web 24 passes through slitter 12, the cutters 26, 28 slit the web so that the center portion 40 forms inner strips 42 and the side portions 38 form outer strips 44 which are thinner in cross sectional thickness than the inner strips. As the recoiler 14 revolves and the strips 30 are rewound into strip coils 32, the diameter of the strip coil comprising the thick inner strips 42 increases at a faster rate than the diameter of the strip coils comprising outer strips 44. Thus, for each successive revolution of the mandrel 36, a greater length of strip is taken up on the strip coils comprising inner strips 42 than that taken up on outer strips 44. Since web 24 is fed into and emerges as strips from slitter 12 at a constant rate, this difference in take up rate causes the outer strips 44 to sag and necessitates the use of looping pit 46 on some prior art slitting lines to accommodate the slack outer strips formed during the rewind process.

Figure 3:
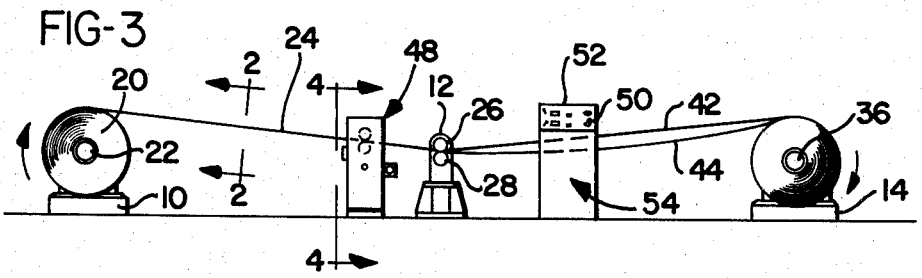
FIG. 3 is a somewhat schematic side elevation of a slitting line embodying the present invention.

A slitting line embodying the present invention is shown in FIG. 3. The slitting line comprises an uncoiler 10, slitter 12, and recoiler 14. Although other components may be used to facilitate the feeding of web 24 into slitter 12, the tensioner 18 of FIG. 1 is no longer required. A deforming station, generally designated 48, is positioned on the slitting line in between uncoiler 10 and recoiler 14. Deforming station 48 has controls 50 which can be integrated into control panel 52 of operator station 54, from which the entire operation of the slitting line is controlled.

The deforming station 48 of the preferred embodiment is best shown in FIGS. 4, 5, 6, and 7. Deforming station 48 consists of a support frame 56, cross beam 58, forming roll 60, and a smooth-surfaced pressure roll 62. Forming roll 60 includes an axle 63 which is rotatably journalled into a pair of vertical members 64 of support frame 56 and includes suitable bearings 66 to reduce friction.

Forming roll 60 also includes a body portion 68 whose outer surface forms a raised pattern consisting of a plurality of circumferential ridges 70 which are sloped to eliminate sharp corners which may be impressed upon the web 24 passing beneath it.

Pressure roll 62 is positioned directly beneath forming roll 60 and is supported by sliding block 72 which slidably engages an upper surface 73 of cross beam 58 at groove 74.

Sliding block 72 includes a pair of upright members 76 which support rocker arms 78. Each rocker arm 78 is pivotally mounted to an upright member 76 at an end and the rocker arms are joined by cross bar 80 at an opposite end. Rocker arms 78 are supported at their opposite end by a double-acting hydraulic cylinder 82 which is pivotally mounted to sliding block 72 by pins 84 and has a rod 86 attached to cross bar 80 by a clevis 88.

Hydraulic cylinder 82 is controlled by a main solenoid valve 90 with which it communicates by means of extension hose 92 and retraction hose 94. Main solenoid 90 joins extension hose 92 and retraction hose 94 with hydraulic supply line 96 and return line 98 which communicate with a hydraulic power unit (not shown).

Main solenoid 90 is of standard design of the type having a first position in which hydraulic fluid flowing through supply line 96 is directed to extension hose 92 thereby causing rod 86 to extend and thereby pivot rocker arms 78 about upright members 76 and thus bring pressure roll 62 toward forming roll 60, and a second position in which hydraulic fluid flowing through supply line 96 is directed through retraction hose 94 which causes rod 86 to retract toward cylinder 82 thereby drawing pressure roll 62 away from forming roll 60.

Sliding block 72 is displaced relative to forming roll 60 by means of a reversible electric motor 100 which is attached to vertical member 64 by an L-shaped bracket 102. Electric motor 100 turns a drive sprocket 104 which is connected to a driven sprocket 106 by a sprocket chain 108. Driven sprocket 106 is fixedly mounted to an end of a threaded spindle 110 which extends between vertical members 64 and is journalled therein. Bearings 112 reduce friction between threaded spindle 110 and vertical members 64. Threaded spindle 110 passes through a nut 114 carried on sliding block 72 and having a thread 116. Thread 116 engages a mating thread 118 recessed into threaded spindle 110.

Thus, rotation of threaded spindle 110 by reversible electric motor 100 causes sliding block 72 to be displaced as thread 116 slides along mating thread 118 and block 72 slides along upper surface 73. By activating motor 100 to rotate drive sprocket 104 in an opposite direction, threaded spindle 110 is made to rotate in an opposite direction thereby causing sliding block 72 to move in an opposite direction along upper surface 73. Both electric motor 100 and main solenoid 90 are activated by control 50 which is an integral part of control panel 52 at operator station 54 (FIG. 3).

Figure 4:
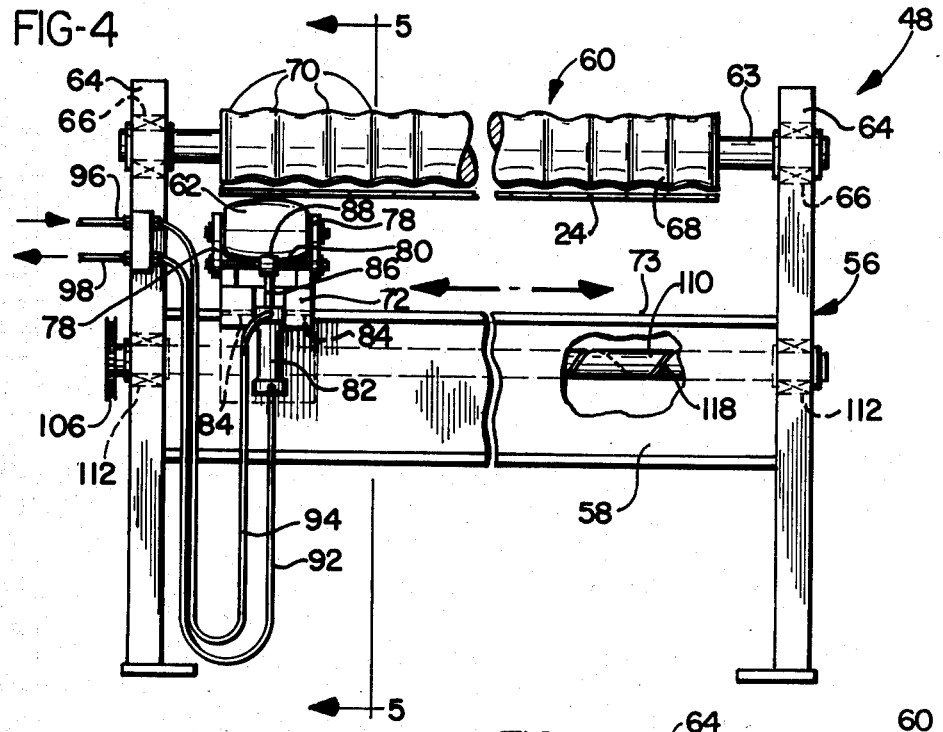
FIG. 4 is an end elevation of a deforming station embodying the present invention taken at line 4—4 in FIG. 3.
Figure 5:
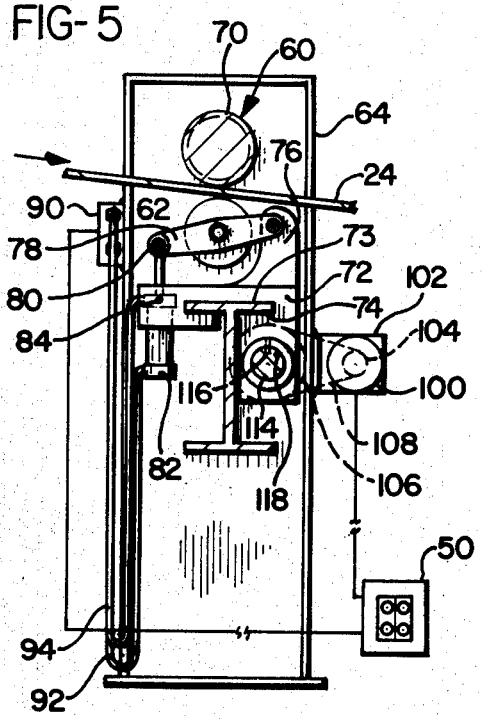
FIG. 5 is a side elevation of the deforming station in FIG. 4 taken at line 5—5 in FIG. 4.

The operation of deforming station 48 of the present invention is as follows. As shown in FIG. 3, a coil 20 of sheet metal is placed on mandrel 22 of uncoiler 10 and fed in between forming roll 60 and pressure roll 62 of deforming station 48. At this time, pressure roll 62 is separated from forming roll 60 as shown in FIGS. 4 and 5. Web 24 is then fed through slitter 12 and slit into strips 30 which are rewound into individual strip coils 32, mounted on mandrel 36 of recoiler 14.

As the slitting and recoiling operation proceeds, outer strips 44, which comprise the thinner side portions 38 of web 24, will begin to slacken in a manner shown in FIG. 3 while inner strips 42, made from the thicker center portion 40 of web 24, remain substantially taut between slitter 12 and recoiler 14.

Figure 6:
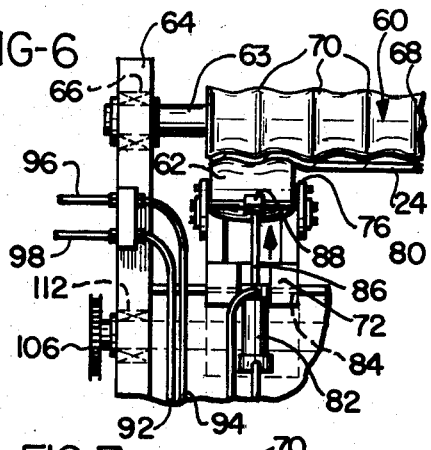
FIG. 6 is a fragmentary end elevation of the deforming station of FIG. 4, but showing the pressure roll engaging the forming roll.
Figure 7:
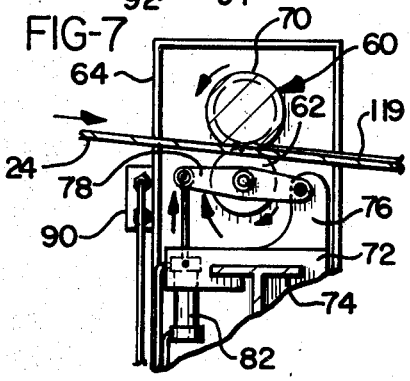
FIG. 7 is a fragmentary side elevation of the view of FIG. 6.

To remedy this situation, an operator standing at operator station 54 activates control 50 to position sliding block 72 so that pressure roll 62 is beneath that portion of web 24 which is slit to become a strip 30 that is slack. By activating motor 100, threaded spindle 110 is rotated, thereby causing sliding block 72 to slide along cross beam 58 to the desired location. Next, the operator activates main solenoid 90 to a first position whereby hydraulic fluid under pressure travels through supply line 96 and extension hose 92 causing rod 86 to extend and thereby pivot rocker arms 78 and pressure roll 62 toward forming roll 60. As shown in FIGS. 6 and 7, pressure roll 62 engages forming roll 60 thereby compressing the desired portion of web 24 into the ridges 70 of the forming roll 60 and imparting a slight deformation 119 to web 24 (FIG. 7).

In those instances where a coil 20 of sheet metal having a web 24 with a crowned contour are being slit, pressure roll 62 will most likely be positioned below one of the side portions 38 of the web as shown in FIGS. 4, 5, 6, and 7. However, if galvanized materials are used it is possible that pressure roll 62 might be positioned below any portion of web 24 as there is a variation in thickness randomly across the width of the web.

Figure 8:
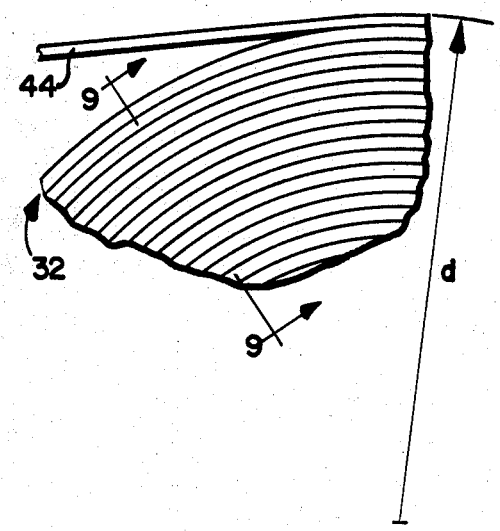
FIG-8 PRIOR ART
FIG. 8 is a fragmentary side elevation of a partially rewound strip coil of a prior art slitting line.
Figure 9:
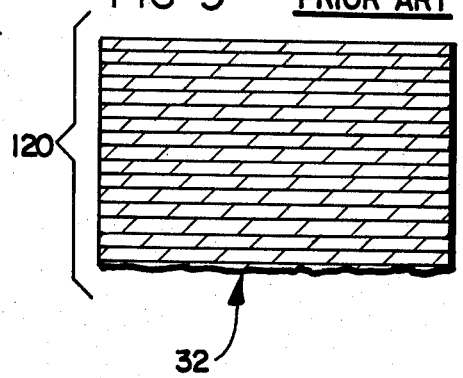
FIG-9 PRIOR ART
FIG. 9 is a section of the fragmentary coil of FIG. 8 taken at line 9—9 in FIG. 8.
Figure 10:
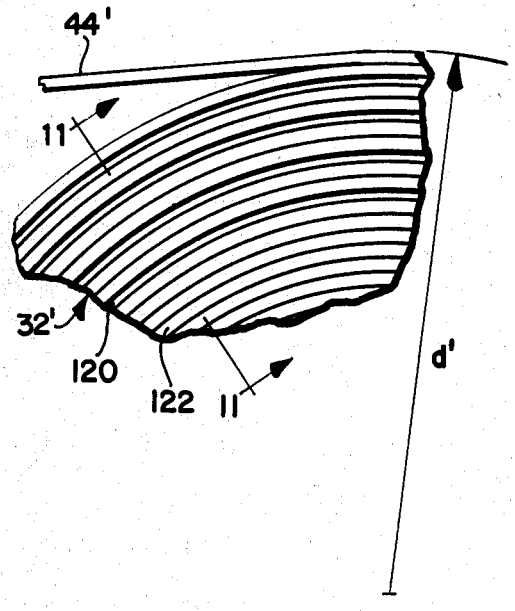
FIG. 10 is a fragmentary side elevation of a partially rewound strip coil treated in the method of the present invention.
Figure 11:
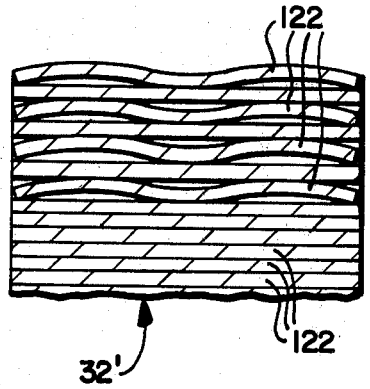
FIG. 11 is a section of the fragmentary coils of FIG. 10 taken at line 11—11 of FIG. 10.

As shown in FIGS. 8 and 9, a strip coil 32 formed from thin outer strip 44 has a diameter d after a given number of revolutions of the recoiler. The overlapping undeformed windings 120 of thin outer strip 44 are shown in section in FIG. 9. However, as shown in FIGS. 10 and 11, the strip coil 32', formed of a combination of deformed windings 122 from deformed strips 44' and undeformed windings 120, has a greater diameter d' after the same number of revolutions of the recoiler. As shown in FIG. 11, this increase in diameter is due to the increase in effective thickness of the deformed windings 122.

By deforming the thinner outer strips 44 during the slitting operation as needed, all the strip coils are maintained at substantially the same diameter for a given number of turns of the mandrel. Therefore, for each turn of the mandrel and strip coils, the same length of strip is taken up onto each strip coil, regardless of the actual thickness of the strip. With the rate of generation of strips from slitter constant across the width of web and the rate of take up of strips by strip coils kept substantially the same, there is no possibility that slack strips will be generated and the slack strip problems are thereby eliminated.

A problem that may be encountered in the recoiling of deformed outer strips onto strip coils is that successive windings of deformed strips may be wound so that their deformations engage each other or "nest". Nesting of deformed strips would substantially reduce the effective thickness of the strips and result in a strip coil having a smaller diameter than one in which strip coils are not nested. Consequently, it is desirable to engage and disengage pressure roll with forming roll so that the resulting strip coil comprises alternating layers of deformed windings 122 and undeformed windings 120 as shown in FIG. 11. The preferred embodiment can be modified to automatically operate this way, as shown in FIG. 12.

Figures 12, 15, 16:
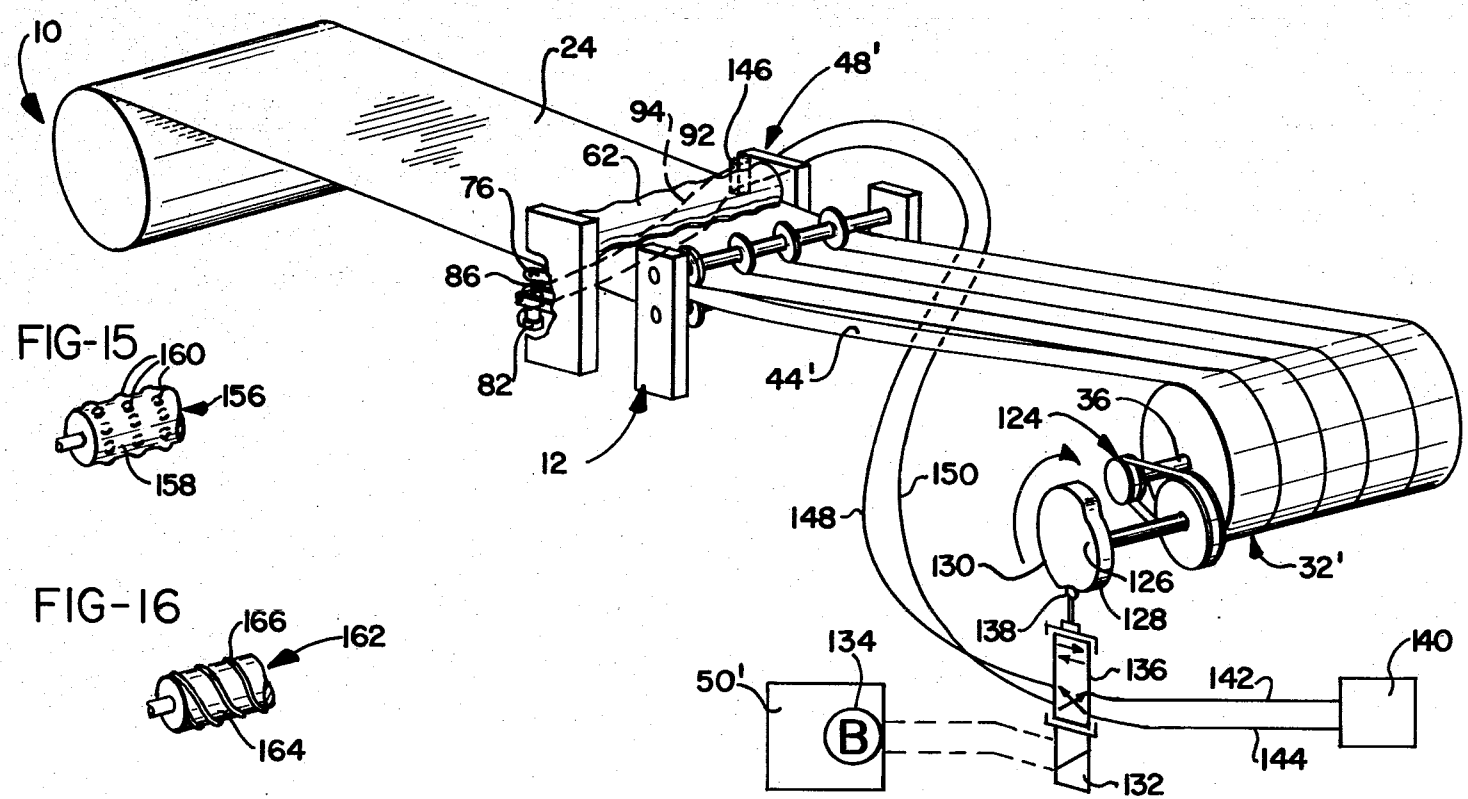
FIG. 12 is a schematic perspective view of a slitting line embodying the present invention and showing an intermittant activator.
FIG. 15 is a fragmentary elevation of another embodiment of the forming roll.
FIG. 16 is a fragmentary elevation of a different embodiment of the forming roll.

In the slitting line shown somewhat schematically in FIG. 12, mandrel 36 of recoiler 14 drives a set of pulleys 124 which in turn rotates a cam 126. The set of pulleys 124 are sized so that two revolutions of mandrel 36 result in one revolution of cam 126. Cam 126 is shaped so that one-half of its circumference consists of a recessed portion 128 and the other half consists of raised portion 130.

A pilot air actuator 132 is activated by a button 134 which forms an integral part of control panel 50'. When activated, actuator 132 moves solenoid 136 so that follower member 138 engages cam 126. Hydraulic solenoid 136 is a "forward-reverse" type and communicates with hydraulic power unit 140 by supply and exhaust lines 142 and 144, respectively.

The deforming station 48' shown in FIG. 12 is similar in construction to deforming station 48 in FIGS. 4, 5, 6, and 7 and names and numerals for the elements of deforming station 48' correspond to like names and numerals used to describe similar elements of deforming station 48. FIGS. 4, 5, 6, and 7 may be referred to in the following discussion since they show in detail the like elements of the deforming stations. However, in deforming station 48' of the embodiment of FIG. 12, the main solenoid 90 is replaced with connector box 146 which connects the solenoid 136 to extension and retraction hoses 92, 94 respectively, by means of feeder hoses 148, 150.

The operation of the deforming station 48 is modified as follows. After the operator has positioned sliding block 72 and pressure roll 62 beneath a selected portion of web 24, he depresses control button 134 which activates pilot air actuator 132 thereby displacing solenoid 136 and bringing follower 138 into engagement with cam 126. As shown in FIG. 12, the follower 138 is engaging the recessed portion 128 of cam 126. In this mode, rod 86 remains extended from hydraulic cylinder 82 thereby holding the pressure roll in a closed relationship to forming roll 60 and no deformation of web 24 occurs.

As cam 126 continues to rotate, follower 138 engages raised portion 130 and hydraulic solenoid 136 is displaced downward to a second position in which hydraulic cylinder 82 is activated to retract rod 86 thereby bringing pressure roll 62 away from forming roll 60 (as shown in FIG. 5) to terminate the deformation process on the selected portion of web 24. When cam 126 has again rotated to a position where follower 138 engages a recessed portion 128, the hydraulic solenoid 136 is repositioned to the first position and the pressure roll 62 engages forming roll 60 and web 24. The length of deformed strip 44' generated during this sequence equals or approaches the circumference of the respective strip coil 32'. Thus, for every rotation of the cam 126—and hence for every two rotations of mandrel 36—a length of strip is generated in which one portion is of a length approximating the circumference of the respective strip coil 32' and is undeformed and a second length is deformed and is also of a length equivalent to the circumference of strip coil. The resultant strip coil 32' is similar to that shown in FIG. 11 in which alternating layers of deformed 120 and undeformed 122 windings are present. In this fashion, the deformed windings 120 are prevented from nesting and thereby reducing the effective diameter of the resultant strip coil 32'.

Figure 13:
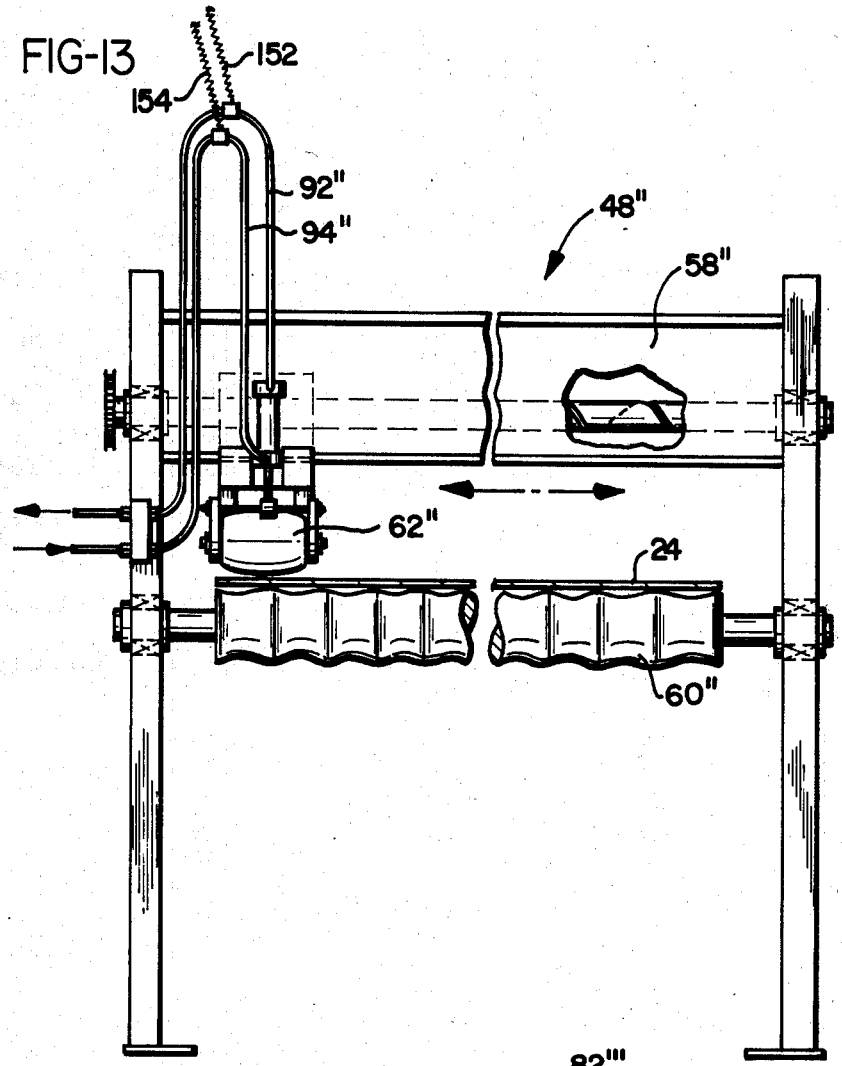
FIG. 13 is an end elevation of a deforming station embodying an alternate embodiment of the present invention.

It should be noted that the cross beam 58 carrying the sliding block 72 and pressure roll 62 need not be located beneath the forming roll 60. As shown in FIG. 13, a deforming station 48'' has a cross beam 58'' above the forming roll 60'' so that the pressure roll 62'' extends downwardly to the forming roll to deform the web 24 as it passes above the forming roll. This arrangement would enable an operator to see the position of the pressure roll 62'' more easily during operation of the deforming station 48''. However, it would be necessary to provide extension hose 92'' and retraction hose 94'' with support springs 152, 154, respectively, to prevent the hoses from dropping down onto the moving web 24 or becoming entangled in the rotating forming roll 60''. The support springs 152, 154 may be attached to a suitable overheat support (not shown).

Figure 14:
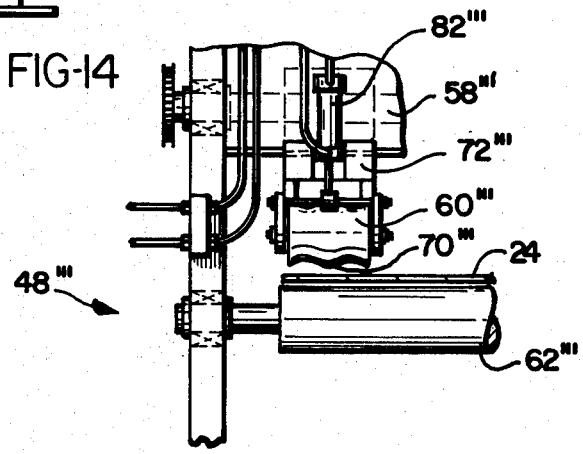
FIG. 14 is a fragmentary end elevation of the deforming station of FIG. 15, but showing the pressure roll carrying a raised pattern and the forming roll having a smooth outer surface.

As shown in FIG. 14, a deforming station 48''' may be constructed so that a forming roll 60''' is shorter in length than the pressure roll 62''' and is carried by a sliding block 72'''. Although FIG. 16 shows sliding block 72''' being carried by cross beam 58''' which is positioned above pressure roll 62''', it would be possible to position the cross beam and forming roll below the pressure roll in a manner similar to that shown in FIG. 4.

With the apparatus depicted in FIG. 14, an operator may still deform a selected portion of a web 24 which passes over and is supported by pressure roll 62. However, in this embodiment the forming roll 60''' is urged downwardly toward the smooth-surfaced pressure roll 62''' by a double-acting cylinder 82''' which results in the selected portion of the web being urged against and deforming into the ridges 70''' of the forming roll 60'''.

Although forming roll 60, as shown in FIGS. 4, 5, 6, and 7, has a body portion 68 having circumferential ridges 70, other types of body portions may be used to impart a deformation to the selected portion of web 24. For example, FIG. 15 shows a forming roll 156 having a body portion 158 with a multiplicity of raised protrusions 160.

FIG. 16 depicts another embodiment in which forming roll 162 has a body portion 164 which forms a helical ridge 166. It is believed that any number of different patterns may be formed on a forming roll without departing from the invention.

Regardless of the particular geometry utilized for the forming roll, the required deformation is slight. For example, the height to width ratio of the ridges of the forming roll of FIGS. 4, 5, 6, and 7 would be in the range of 0.01 to 0.001 and would not present an extreme appearance problem on smooth materials. Furthermore, if the strip is blanked, drawn, roll-formed or mildly worked in any way, evidence of deformation will be substantially removed.

The apparatus of the invention can be fabricated from standard materials. For example, the support frame and cross beam can be fabricated from a medium strength steel or "black iron". It is desirable to form the body portion of the forming roll from steel, cast iron, or other material having a high resistance to abrasion. The pressure roll should be made from hard rubber or plastic material so that it can deform to match the contours of the body portion of the forming roll but have enough resistance to deformation to force the selected portion of the web passing between the pressure roll and the forming roll into the forming roll. Such items as the threaded spindle and nut should also be made of abrasion resistant material.

While the forms of apparatus herein described constitute preferred embodiments of this invention, it is to be understood that the invention is not limited to these precise forms of apparatus, and that changes may be made therein without departing from the scope of the invention.

What is claimed is:

1. In combination with a metal slitting operation including the steps of uncoiling a web having portions of varying thicknesses from a metal coil, slitting said web into a plurality of strips having said portions of varying thicknesses, and recoiling said strips into individual strip coils, the method of tensioning strips comprising the step of:

selectively deforming only thinner ones of said portions of said web intermediate said uncoiling and recoiling steps while leaving thicker ones of said portions undeformed so that a raised pattern is imparted to said thinner ones and strips formed from said deformed thinner ones have an increased effective cross sectional thickness such that coils formed from said strips of said deformed thinner ones during said recoiling step have a larger diameter than if said thinner ones were not so deformed so that the strip coils formed from both said thinner and thicker ones of said portions are of similar diameter and the strips can be recoiled at the same rate, thereby preventing the formation of slack strips during said recoiling step.

2. The method of tensioning strips, as in claim 1, wherein said deforming step is performed by:

selecting a thinner one of said portions of said web;

passing said selected thinner ones of said portions between a forming roll and a pressure roll, at least one of said rolls having a raised pattern on the surface thereof; and compressing said forming roll and said pressure roll together so that said selected thinner one is deformed by said raised pattern of said forming roll and the effective cross sectional thickness of said selected thinner one is increased and deformed thinner strips are formed therefrom.

3. The method of tensioning strips, as in claim 2, wherein said pressure roll has a width less than that of said forming roll and said deforming step further comprises the step of positioning said pressure roll proximate said selected thinner on of said portions of said web immediately prior to said compressing step.

4. The method of tensioning strips, as in claim 2, wherein said deforming step further comprises the step of controlling the compressing of said forming roll and said pressure roll so that strip coils formed from said deformed thinner strips have alternating windings of deformed thinner strips and nondeformed thinner strips.

5. The method of tensioning strips, as in claim 1, wherein said deforming is performed prior to said slitting step.

6. In combination with a slitting line of the type having an uncoiler for uncoiling a coiled metallic web having portions of varying thicknesses, a slitter for slitting said web into strips, and a recoiler for recoiling said strips into individual strip coils, the improvement which comprises:

means for deforming only selected thinner ones of said portions of said web while leaving thicker ones of said portions undeformed to impart a raised pattern thereon such that deformed strips are formed from said selected thinner ones having an increased effective cross sectional thickness, such that coils formed from said strips of said deformed thinner ones during said recoiling step have a larger diameter than if said thinner ones were not so deformed so that the strip coils formed from both said thinner and thicker ones of said portions are of similar diameter and the strips can be recoiled at the same rate by said recoiler, thereby preventing the formation of slack strips during operation of the recoiler.

7. The slitting line of claim 5 wherein said deforming means comprises:

a forming roll;

a pressure roll;

a raised pattern formed on an outer surface of at least one of said rolls;

means for supporting said forming roll transversely across an opposite surface of the web and positioning said pressure roll adjacent a selected portion of said opposite surface of said web; and means for urging said pressure roll and said forming roll together.

8. The slitting line of claim 7 wherein said raised pattern consists of a plurality of discrete raised ridges extending about the circumference of said outer surface.

9. The slitting line of claim 7 wherein said raised pattern consists of a plurality of raised protrusions spaced about said outer surface.

10. The slitting line of claim 7 wherein said raised pattern consists of a raised helical ridge formed on said outer surface.

11. The slitting line of claim 7 wherein said outer surface of said forming roll has a raised pattern formed thereon and said pressure roll has a smooth surface.

12. The slitting line of claim 7 wherein said outer surface of said pressure roll has a raised pattern formed thereon and said forming roll has a smooth surface.

13. The slitting line of claim 7 wherein said support means for said forming roll includes a support frame.

14. The slitting line of claim 13 wherein said support means for said pressure roll comprises:

a cross beam mounted transversely across said support frame;

a sliding block slidably engaging said cross beam;

a pair of upright members extending from said sliding block toward the opposite surface of the web;

a pair of rocker arms each rotatably attached at an end to one of said upright members and spaced to receive said pressure roll therebetween such that each end of said pressure roll is journalled into one of said rocker arms; and means for rotating said rocker arms about said upright member such that said pressure roll is pressed into or away from said forming roll thereby engaging or disengaging said web passing between said forming roll and said pressure roll.

15. The slitting line of claim 14 wherein said pivoting means includes:

a double-acting cylinder extending between said sliding block and an opposite end of said rocker arms; and control means for activating said cylinder to extend so that said pressure roll rotates toward said forming roll or to retract so that said pressure roll rotates away from said forming roll.

16. The slitting line of claim 15 wherein said control means includes a solenoid responsive to rotation of the recoiler so that said cylinder extends to rotate said pressure roll into said forming roll and hold for a predetermined number of revolutions of said recoiler, then retracts to rotate said pressure roll away from said forming roll and hold for a second predetermined number of revolutions of said recoiler, thereby eliminating nesting of deformed strips on the recoiler.

17. The slitting line of claim 14 wherein said pressure roll is shorter than said forming roll and further comprising means for displacing said pressure roll along the length of said forming roll.

18. The slitting line of claim 17 wherein said displacing means includes:

a threaded spindle rotatably mounted transversely across said support frame;

a nut fixedly mounted on said sliding block and engaging said threaded spindle;

means for rotating said threaded spindle; and control means for selectively activating said rotating means in a forward mode and a reverse mode, and for deactivating said rotating means.

19. The slitting line of claim 18 wherein said rotating means includes:

a reversible motor and a driving sprocket attached thereto;

a sprocket chain engaging said driving sprocket; and a driven sprocket fixedly attached to said threaded spindle and linked to said driving sprocket by said sprocket chain.

20. The slitting line of claim 5 wherein said deforming means is positioned between said uncoiler and said slitter.

* * * * *

UNITED STATES PATENT AND TRADEMARK OFFICE

CERTIFICATE OF CORRECTION

PATENT NO. : 4,347,723

DATED : September 7, 1982

INVENTOR(S) : Charles R. Bradlee

It is certified that error appears in the above—identified patent and that said Letters Patent is hereby corrected as shown below:

Col. 10, line 39, "overheat" should be --overhead--.

Col. 12, line 4, "on" should be --one--.

Signed and Sealed this

*Twenty-third* Day of *November 1982*

[SEAL]

*Attest:*

GERALD J. MOSSINGHOFF

*Attesting Officer*

*Commissioner of Patents and Trademarks*